US005095620A

United States Patent [19]

Althaus

[11] Patent Number: 5,095,620

[45] Date of Patent: Mar. 17, 1992

[54] RAZOR BLADE UNIT

[75] Inventor: Wolfgang Althaus, Wuppertal, Fed. Rep. of Germany

[73] Assignee: Wilkinson Sword Gesellschaft mit beschränkter Haftung, Solingen, Fed. Rep. of Germany

[21] Appl. No.: 639,805

[22] Filed: Jan. 10, 1991

[30] Foreign Application Priority Data

Mar. 8, 1990 [DE] Fed. Rep. of Germany ... 9002710[U]

[51] Int. Cl.[5] ..... B26B 21/00; B26B 19/40

[52] U.S. Cl. ..... 30/41; 30/32

[58] Field of Search ..... 30/32, 41, 43.6, 63, 30/84, 86

[56] References Cited

U.S. PATENT DOCUMENTS 3,738,000 6/1973 Samko ..... 30/32
4,170,821 10/1979 Booth ..... 30/41
4,328,615 5/1982 Bowman et al. ..... 30/3.2
4,683,096 7/1987 Ferraro ..... 30/41
4,875,287 10/1989 Creasy et al. ..... 30/41

FOREIGN PATENT DOCUMENTS 2851457 6/1979 Fed. Rep. of Germany .
3814135 11/1988 Fed. Rep. of Germany .

*Primary Examiner*—Douglas D. Watts
*Assistant Examiner*—Paul M. Heyrana
*Attorney, Agent, or Firm*—Robert W. Becker & Associates

[57] ABSTRACT

A razor head, especially a razor blade unit, is disposed at the front end of a handle of a wet razor and includes a plastic housing which is provided with a forward guide strip and a rear cover, with a razor blade being embedded in the plastic housing. A separate glide strip is disposed on the cover. So that the razor head provides a more comfortable shave, the cover is essentially formed exclusively by the glide strip.

7 Claims, 2 Drawing Sheets

RAZOR BLADE UNIT

BACKGROUND OF THE INVENTION

The present invention relates to a razor head, especially a razor blade unit, that is disposed at the front end of a handle of a wet razor and that includes a plastic housing which is provided with a forward guide strip and a rear covering means, with a razor blade means being embedded in the plastic housing.

Wet or safety razors basically comprise a handle, at the front end of which is disposed a razor head. To form a so-called disposable razor, the razor head can be integrally formed with the handle. Alternatively, for this purpose so-called razor blade units are also known where a single or double razor blade is fixedly embedded in a plastic housing and the razor blade unit can be replaceably disposed at the front end of a handle of the razor via an appropriate mechanism.

As mentioned above, both with a disposable razor as well as with a razor blade unit, the razor head comprises a plastic housing in which is embedded a razor blade means. This plastic housing includes a forward guide strip and a rear covering means that together with the cutting edge of the razor blade means define the shaving geometry. In order to improve the shaving characteristics of the razor head, the covering means is provided with a glide strip. This glide strip is a solid yet water-soluble shaving aid that reduces the frictional resistance between the skin and the razor head while shaving. With the heretofore known razors, the covering means is provided with a recess that extends parallel to the cutting edge of the razor blade; the glide strip is inserted into this recess. The drawback of this known arrangement is that the glide strip projects beyond the surface of the covering means, and thus alters the shaving geometry in such a way that the shaving result is adversely affected. This is due to the fact that the guide strip constitutes only a portion of a relatively wide covering means. This results in relatively poor gliding properties, so that a comfortable shave is no longer possible, which is particularly critical for sensitive skin.

It is therefore an object of the present invention to improve a razor head of the aforementioned general type in such a way that a more comfortable shave can be achieved therewith.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
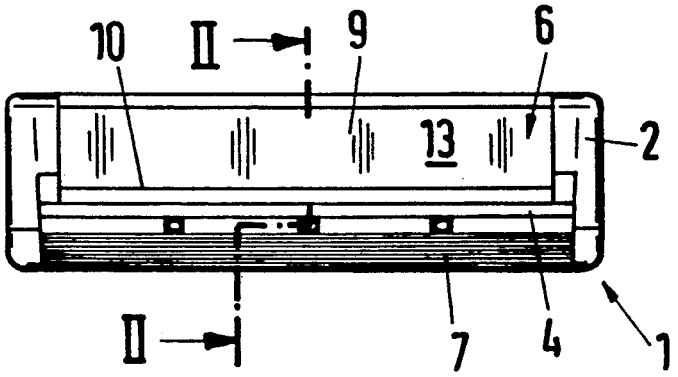
FIG. 1 is a plan view of a first exemplary embodiment of the inventive razor head.

The razor head of the present invention is characterized primarily by a separate glide strip that is disposed on the covering means, with the covering means being essentially formed exclusively by this glide strip.

Due to the fact that the inventive razor head, especially a razor blade unit of a wet razor, has an extremely wide glide strip that forms the entire surface behind the cutting edge of the razor blade means, and hence forms the covering means, a particularly comfortable shave is possible that is particularly noticeable in a positive sense with sensitive skin. In particular, it was surprisingly discovered that an increase of the effective surface of the glide strip leads to an improvement in shaving comfort, especially with regard to the gentleness and smoothness of the shave. The reason for this is that an increased glide strip surface, while not changing the introduction of force into the razor, leads to a less pronounced deformation of the skin, and the reduced specific surface pressure or pressure per unit of area activates the glide layer in a better and lasting manner. The consequence of the surprising success of the widening of the guide strip is thus an improved gliding property. In this connection, it should be noted that during the shaving process the classical mechanical principles are not applicable. Whereas according to these principles the coefficient of friction and hence the frictional force are independent of the size of the contact surface (under the premise that the friction parts are not elastic), the surprising effect was discovered during wet shaving that the coefficient of friction is a function of the size of the support surface of the friction parts. The larger the surface, the lower is the coefficient of friction. The reason for this during wet shaving is that the skin is elastic. Finally, the wider glide strip has the advantage that thereby an optimum, uniform shaving angle is defined without thereby destroying, for example, the shaving geometry.

Pursuant to one preferred specific embodiment of the present invention, the glide strip has an essentially wedge-shaped configuration, and is inserted into the recessed surface portion of the plastic housing in such a way that the wedge point is oriented toward the front in the direction of shaving. To fix the position of the glide strip, it can in particular be glued in. The wedge shape of the glide strip has the advantage that thereby an optimum shaving geometry can be established, with the point of the wedge of the glide strip being disposed essentially directly behind the cutting edge of the razor blade means and extending parallel thereto.

As an alternative, the glide strip can also be a foil or very thin sheet that is, for example, glued to the surface of the plastic housing. The plastic housing in this embodiment has a wedge-shaped configuration so that the covering means, respectively, the glide strip, extends in a wedge-like manner relative to the razor blade means. The advantageous shaving geometry is thereby established.

Pursuant to one specific embodiment, it is proposed that the glide strip have an essentially flat outer surface. In this way, the frictional resistance of the glide strip is reduced to a minimum.

Although the inventive concept, namely that the covering means is formed exclusively by the glide strip can in principle also be utilized for a razor head having a double razor blade, pursuant to one preferred application of the inventive concept a single razor blade is disposed in the plastic housing. The advantage of a single blade is that the outer surface of the razor blade means represents only a narrow strip, so that the relatively wide surface behind the razor blade means in the region of the covering means is formed by a very wide glide strip that is approximately twice as wide as the glide strip of the conventional razor heads. This means that for the customary dimensions of razor heads or razor blade units, the width of the glide strip as viewed in the direction of shaving is approximately 6mm.

It is finally proposed pursuant to a further specific embodiment that the material for the glide strip be a xerogel that, when it receives water as a dispersion medium, is converted into a lyogel that glides very easily upon the skin of the user and has a coefficient of friction $\mu<0.25$. Such a glide material has the advantage of having a very low coefficient of friction, so that an extremely smooth and comfortable shave is possible when such a glide strip is used. Such a glide material is described in U.S. patent application 07,285,175, which belongs to the assignee of the present application, and the disclosure of which is hereby incorporated herein by this reference thereto. In general, xerogels, which contain no liquid, for example silica gel or gelatin flakes, are substances that when water is added swell and are converted into lyogels, e.g. hydrogels, which then contain liquid. It is important to remember that the highly glidable lyogel that results when the xerogel absorbs water is not water soluble, so that during shaving none of the lubricant material of the glide strip is lost.

Further specific features of the present invention will be described in detail subsequently.

DESCRIPTION OF PREFERRED EMBODIMENTS

Figure 2:
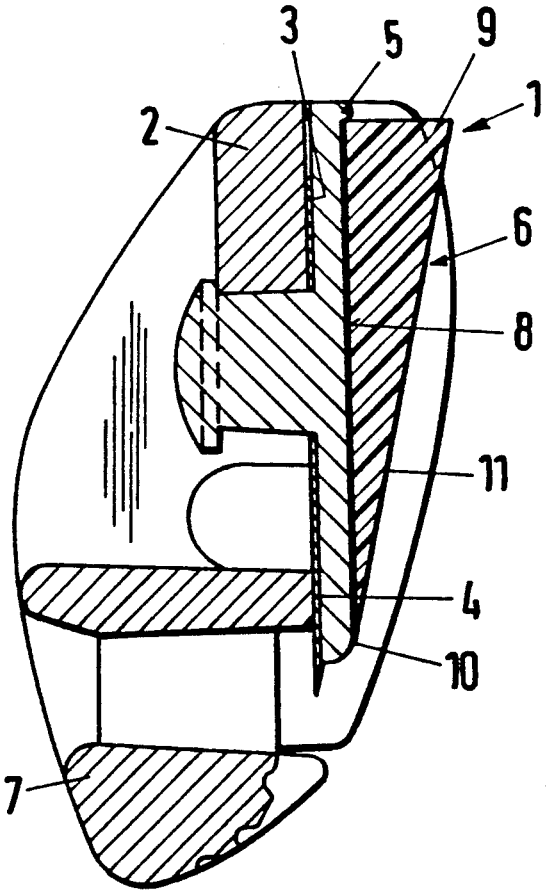
FIG. 2 is an enlarged cross-sectional view taken along the line II—II in FIG. 1.

Referring now to the drawings in detail, the first exemplary embodiment of a razor blade unit 1 as illustrated in FIGS. 1 and 2 comprises a plastic housing 2 in which is fixedly embedded a razor blade means 4 that in this embodiment is in the form of a single razor blade and rests upon a blade support 3. In this connection, the razor blade means 4 is sandwiched in position between the blade support 3 of the plastic housing 2 and the upper housing 5 for a covering means 6, with the plastic housing 5 being riveted or otherwise fastened with the plastic housing 2. The plastic housing 2 is furthermore provided with a forward guide strip 7 that extends parallel to the cutting edge of the razor blade means 4.

The housing 5 for the covering means 6 is provided on the outer surface with a recessed portion 8. A wedge-shaped glide strip 9 is received in the recessed portion 8, where it is fixed, for example, by being glued therein. In this connection, the wedge point 10 of the glide strip 9 is oriented in the direction of shaving and extends parallel to the cutting edge of the razor blade means 4. The surface 11 of the glide strip 9 is flat.

As can be seen from the drawings, the glide strip 9 covers nearly the entire surface rearwardly of the razor blade means 4, and thus forms the covering means 6, which together with the forward guide strip 7 and the razor blade means 4 define the cutting geometry of the razor blade unit 1. The wide glide strip 9 is a prerequisite for an exceptionally comfortable shave and for a well-defined shaving angle.

Figure 3:
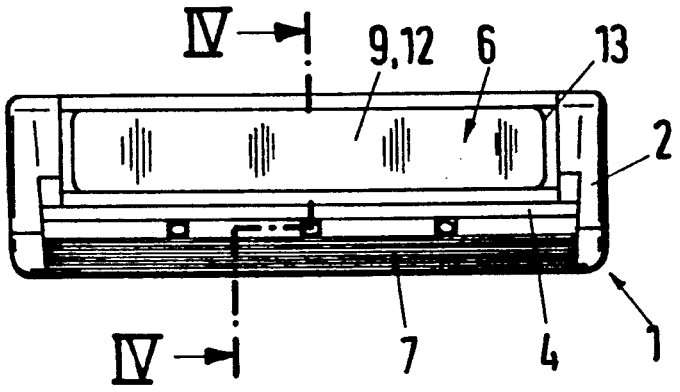
FIG. 3 is a plan view of a second exemplary embodiment of the inventive razor head.
Figure 4:
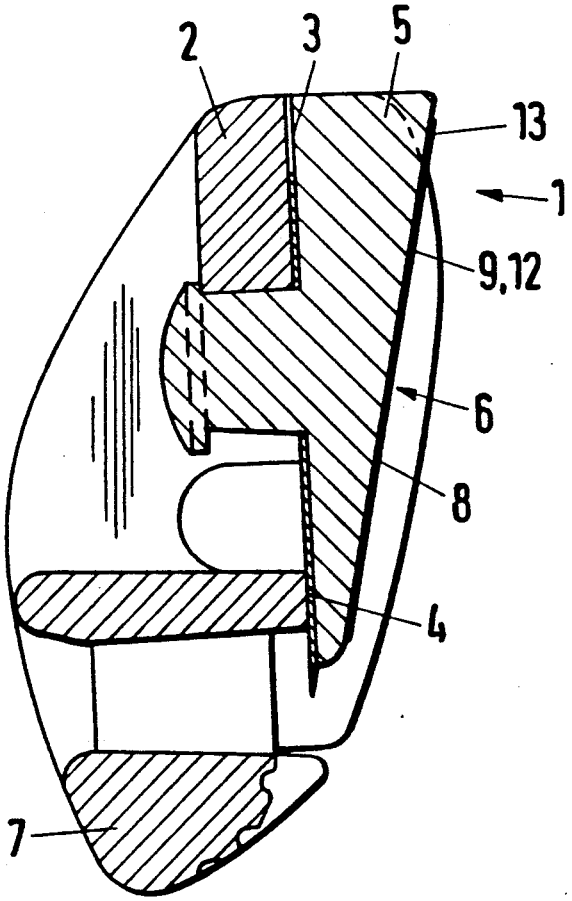
FIG. 4 is an enlarged cross-sectional view taken along the line IV—IV in FIG. 3.

The basic construction for the second exemplary embodiment illustrated in FIGS. 3 and 4 is the same as for the first embodiment of FIGS. 1 and 2. The only difference is in the construction and mounting of the glide strip 9. In particular, in this embodiment the glide strip 9 is in the form of a foil or very thin sheet 12 that is glued or otherwise secured to the surface 13 of the plastic housing 2, and in this connection in particular upon the wedge-shaped housing 5 of the covering means 6. This foil 12 is also very wide and defines the actual covering means 6. Just like with the wedge-shaped glide strip 9 of the first embodiment, the outer surface of the foil 12 of the second embodiment is flat.

As was the case with the first embodiment, the second embodiment of the razor blade unit 1 is characterized by an exceptionally comfortable shave and by a well-defined shaving angle.

The present invention is, of course, in no way restricted to the specific disclosure of the specification and drawings, but also encompasses any modifications within the scope of the appended claims.

What I claim is:

1. A razor head that is disposed at the front end of a handle of a wet razor and that includes a plastic housing which is provided with a forward guide strip and a rear covering means, with a razor blade means being embedded in said plastic housing, said razor head further comprising:

a separate glide strip that is disposed on said covering means, with said covering means being essentially formed exclusively by said glide strip and extending in a wedge-like manner relative to said razor blade means, with a wedge point of said covering means being oriented in the direction of said forward guide strip, thereby establishing an optimum shaving geometry.

2. A razor head according to claim 1, in which said glide strip has an essentially wedge-shaped configuration and is disposed in a recessed surface portion of said plastic housing.

3. A razor blade according to claim 1, in which said glide strip is a foil that is mounted on a surface of said plastic housing.

4. A razor blade according to claim 1, in which said glide strip has an essentially flat outer surface.

5. A razor blade according to claim 1, in which said razor blade means is a single razor blade.

6. A razor head according to claim 5, in which said glide strip, as seen in a direction of shaving, has a width of approximately 6mm.

7. A razor head according to claim 1, in which the material of said glide strip is a xerogel that, when it receives water as a dispersion medium, is converted into a lyogel that glides very easily upon the skin of a user and has a coefficient of friction $\mu<0.25$.

* * * * *